US008128373B2

(12) United States Patent
Webb

(10) Patent No.: US 8,128,373 B2
(45) Date of Patent: Mar. 6, 2012

(54) TURBINE ROTOR WITH LOCKING PLATES AND CORRESPONDING ASSEMBLY METHOD

(75) Inventor: Rene James Webb, Notts (GB)

(73) Assignee: Siemens Aktiengesellschaft, Munich (DE)

( * ) Notice: Subject to any disclaimer, the term of this patent is extended or adjusted under 35 U.S.C. 154(b) by 174 days.

(21) Appl. No.: 12/311,255

(22) PCT Filed: Aug. 22, 2007

(86) PCT No.: PCT/EP2007/058740

§ 371 (c)(1),
(2), (4) Date: Mar. 24, 2009

(87) PCT Pub. No.: WO2008/037550

PCT Pub. Date: Apr. 3, 2008

(65) Prior Publication Data

US 2010/0014978 A1 Jan. 21, 2010

(30) Foreign Application Priority Data

Sep. 25, 2006 (EP) ..... 06020048

(51) Int. Cl.
*F01D 5/32* (2006.01)
*F01D 5/26* (2006.01)

(52) U.S. Cl. ..... 416/220 R; 416/500; 29/889.2; 29/889.21

(58) Field of Classification Search ..... 415/115–116; 416/95, 96 R, 96 A, 97 R, 219 R, 220 R, 416/221, 248, 500; 29/889.2, 889.21, 889.22
See application file for complete search history.

(56) References Cited

U.S. PATENT DOCUMENTS

| | | | | |
|---|---|---|---|---|
| 3,318,573 | A | 5/1967 | Matsuki et al. | |
| 3,748,060 | A | 7/1973 | Hugoson et al. | |
| 4,019,833 | A * | 4/1977 | Gale | 416/220 R |
| 4,108,571 | A * | 8/1978 | Mawson | 416/221 |
| 4,247,257 | A * | 1/1981 | Benoist et al. | 416/221 |
| 4,275,990 | A * | 6/1981 | Langley et al. | 416/220 R |
| 5,211,407 | A | 5/1993 | Glynn et al. | |
| 5,662,458 | A * | 9/1997 | Owen | 416/220 R |
| 2006/0239822 | A1 * | 10/2006 | Wulf | 416/220 R |

FOREIGN PATENT DOCUMENTS

| | | | |
|---|---|---|---|
| EP | 1657404 | A1 | 5/2006 |
| GB | 2016092 | A | 9/1979 |
| GB | 2151714 | A | 7/1985 |
| GB | 2258273 | A | 2/1993 |
| GB | 2302711 | A | 1/1997 |
| SU | 533738 | A1 | 10/1976 |
| SU | 881354 | A1 | 11/1981 |

* cited by examiner

*Primary Examiner* — Christopher Verdier

(57) ABSTRACT

A turbine rotor with a rotor disc, a plurality of slots arranged on the rotor disc, a plurality of blades having blade roots and arranged in the slots, and a plurality of locking plates fitted in a position between the rotor disc and the blades are provided. The first gaps on radially outside edges and second gaps on radially inside edges, relative to an axis of rotation of the rotor disc, are formed between neighboring locking plates. At least one of the first gaps is smaller than the corresponding second gap, wherein at least one first gap and corresponding second gaps are intentionally introduced.

7 Claims, 2 Drawing Sheets

TURBINE ROTOR WITH LOCKING PLATES AND CORRESPONDING ASSEMBLY METHOD

CROSS REFERENCE TO RELATED APPLICATIONS

This application is the U.S. National Stage of International Application No. PCT/EP2007/058740, filed Aug. 22, 2007 and claims the benefit thereof. The International Application claims the benefits of European Patent Office application No. 06020048.2 EP filed Sep. 25, 2006, both of the applications are incorporated by reference herein in their entirety.

FIELD OF THE INVENTION

The invention relates to a turbine rotor and a blade locking arrangement.

BACKGROUND OF THE INVENTION

Rotor blades are mounted on the periphery of a turbine rotor disc by profiled blade roots fitted into corresponding slots in the rotor disc. The profile takes up the radially directed forces occurring during the operation of a gas turbine.

When mounted in essentially axial slots a locking feature is required to prevent the blade roots from moving in the slots during operation, due to gas load.

One arrangement known from the state of the art is to use segmental plates fitted between blade roots and rotor disc and mounted in respective annular grooves in the blade roots and the rotor disc to provide axial retention. Such an arrangement usually only allows for small manufacturing tolerances since it is important that the loading due to the centrifugal forces of the locking plates onto the blades above it and the damping of blade vibrations through the locking plates is consistent. The locking plates must be free to articulate to cope with deviations in manufacturing tolerances of the grooves in the disc, holding the plates, the deviations causing a radial or rotational movement of the plate.

Furthermore a compromise must be found for the size of the gap space between locking plates. On the one hand, if gap spaces between locking plates are too narrow, they will lock up during the start-up phase. Due to the low thickness of the locking plates compared to the rotor disc and the rotor blades, the thermal inertia of the locking plates is smaller and thus their thermal expansion is quicker than for the rotor disc and the rotor blades. On the other hand, if gap spaces between locking plates are wide, sealing between blade roots and rotor disc and between blades is poor.

GB 2 258 273 A describes a rotor blade locking assembly having plates trapped between retaining hooks integral with rotor disc and blade roots. The plate covers and seals the space between blade roots and rotor disc.

EP 1 657 404 A1 describes a rotor of gas turbine having the rotor blades anchored by in axial slots in the body of the rotor and secured by locking plates. The locking plates have a kite-like and especially a parallelogram or rhomboid-like base contour and are fitted in a position between the rotor body and rotor blades and then in an assembly position rotated relative to the inserted position into the annular grooves formed in the rotor body and in the blades.

SUMMARY OF THE INVENTION

An object of the invention is to provide a new turbine rotor having a locking assembly with improved loading and damping properties onto the blades and a better sealing behind the blades.

This objective is achieved by the claims. The dependent claims describe advantageous developments and modifications of the invention.

An inventive turbine rotor comprises a rotor disc having slots arranged on the rotor disc and rotor blades having blade roots arranged in the slots. An annular groove in the periphery of the rotor disc and complementary grooves in the blades are adapted to trap between them a plurality of locking plates. The locking plates extend circumferentially over at least two neighbouring halves of blade roots and radially in the plane of the rotor disc to cover the space between blade roots and the rotor disc and space between blades. An advantage of this arrangement with two plate edges per blade is that in case of a single locking plate failure, the blade is still prevented from falling out axially.

The locking plates have the contour of a sector of a circle where the tip in the form of another sector of a circle has been removed so that the border of the locking plates has two opposing concentric circular arcs and two opposing non-parallel straight lines. The taper of the locking plates is intentionally such that the gaps formed between neighbouring locking plates on the outer edge relative to the axis of rotation of the rotor disc are smaller than the corresponding inner gaps. This allows for articulation of the locking plates to cope with tolerances and minimizes gap spaces between locking plates for a better sealing without locking up during transients/start-up of the turbine. The better the articulation is, the more balanced is the loading onto the blades and the more consistent is the damping of blade vibrations. Smaller gap spaces reduce leakage and increase the performance of the turbine engine.

During the operation of the gas turbine, the centrifugal forces effect an outward loading or movement of the locking plates, as a result of which the locking plate is positioned in the groove of the rotor disc. Thus, the blade root is accurately positioned relative to the rotor disc during operation.

By such a design of the locking plate an improved rotor disc is achieved.

BRIEF DESCRIPTION OF THE DRAWINGS

The invention will now be further described, with reference to the accompanying drawings in which.

Figure 1:
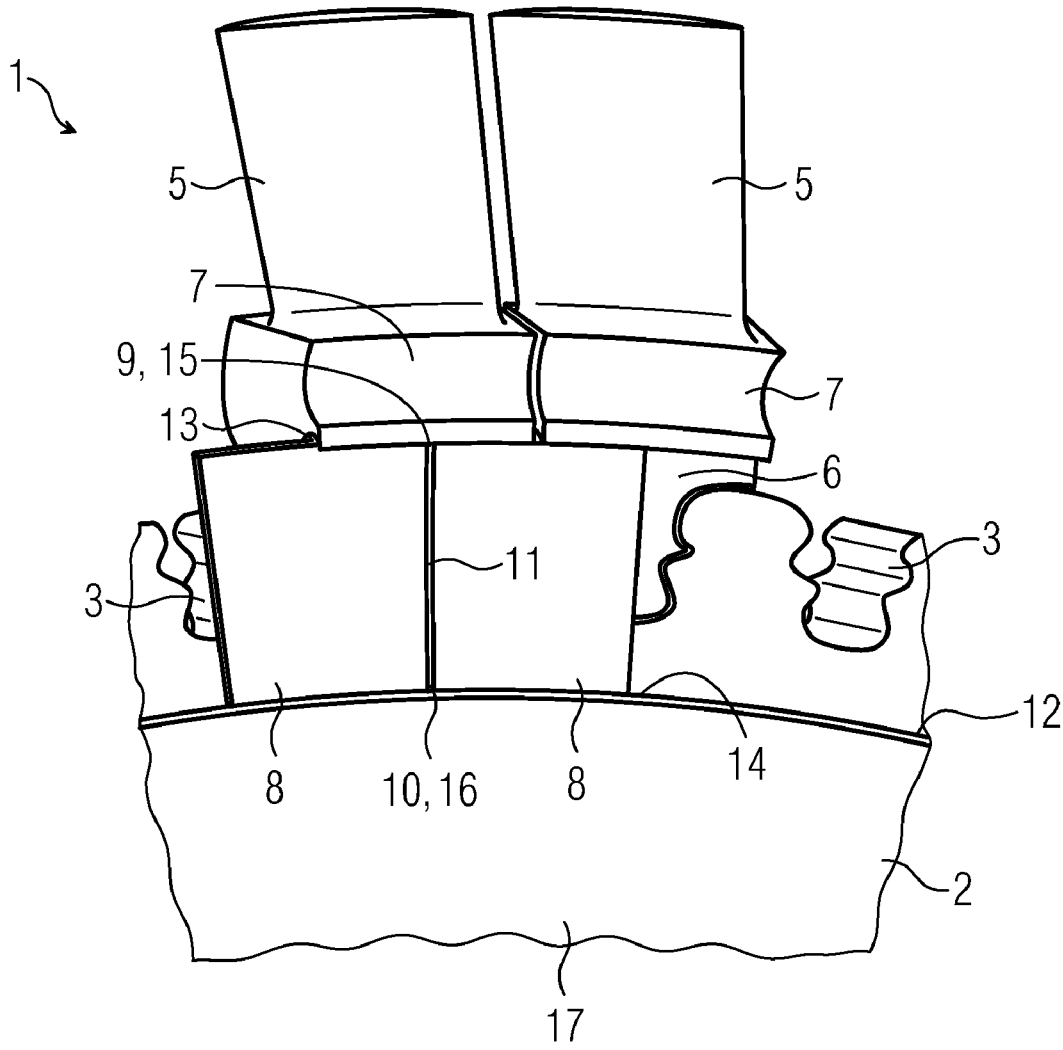
FIG. 1 is an axial view of part of a rotor disc.

In the drawings like references identify like or equivalent parts.

DETAILED DESCRIPTION OF THE INVENTION

Referring to the drawings, FIG. 1 shows a part of a conventional gas turbine rotor 1, including rotor disc 2, blades 5 and locking plates 8. A blade 5 comprises a platform 7 and a blade root 6. The blade roots 6 are fitted in an axial direction in the slots 3 of the rotor disc 2. The locking plates 8 are in position on an axial rotor disc face 17 and extend over two neighbouring halves of blade roots 6. They are retained in an annular groove 12 in the periphery 14 of the rotor disc 2 and complementary grooves 13 in the blades 5.

Figure 2:
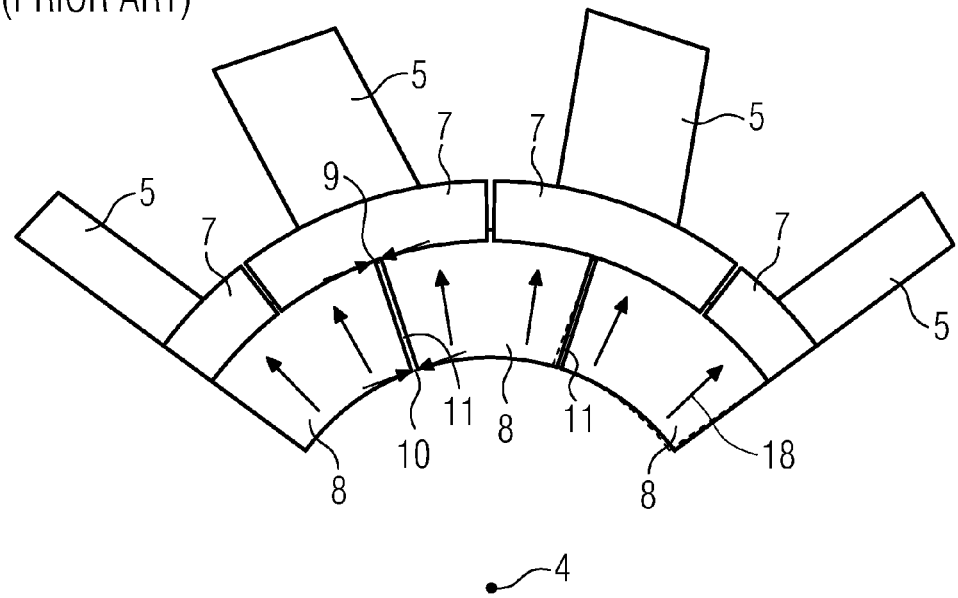
FIG 2 (PRIOR ART)
FIG. 2 is showing the locking plates with prior art gap spaces.

FIG. 2 shows an arrangement of prior art locking plates 8 around an axis of rotation 4 of a rotor disc 2, having gap spaces 11 with parallel longitudinal sides, thus the first and second gaps 9, 10 at the ends of the gap spaces are equal. During operation, the locking plates exert a centrifugal force 18 directed away from the center of rotation upon the annular grooves 13 of the blades 5 and align with the corresponding blades. The gap spaces 11 should be close enough to reduce leakage. But they also should allow for articulation. On the left side of FIG. 2 the gap space is large and leakage is high. On the right side of FIG. 2 the gap space is small and does not allow for articulation. The locking plates cannot cope with transients and will lock up (dashed lines).

Figure 3:
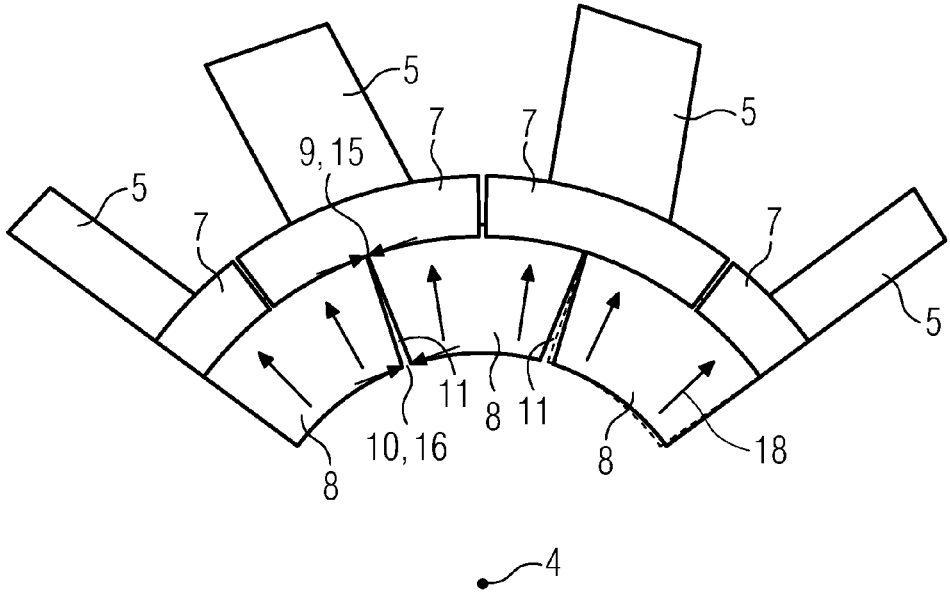
FIG. 3 is showing the inventive locking plates.

FIG. 3 shows an arrangement of the inventive locking plates 8 around an axis of rotation 4. Assembly and positioning of locking plates is as in prior art. However, the longitudinal sides of gaps spaces 11 formed by two neighbouring inventive locking plates 8 are not parallel but tapered so that smaller gaps 9, narrow ends 15, are on the radially outside edges and larger gaps 10, wide ends 16, on the radially inside edges. The locking plates are allowed to articulate and to align (dashed lines) with the corresponding blades 5 without locking up.

What is claimed is:

1. A turbine rotor, comprising:

a rotor disc;

a plurality of slots arranged on the rotor disc;

a plurality of blades having a plurality of blade roots and arranged in the plurality of slots;

a plurality of locking plates fitted in a position between the rotor disc and the plurality of blades; and a plurality of gaps formed between a plurality of neighbouring locking plates, each gap having:

a first gap width formed on a radially outermost end of the neighbouring locking plates, the first gap formed relative to an axis of rotation of the rotor disc, and a second gap width formed on a radially innermost end of the neighbouring locking plates, the second gap formed relative to the axis of rotation of the rotor disc, wherein at least one of the plurality of first gap widths is smaller than a corresponding second gap width such that the gap foamed by the corresponding first gap width and the second gap width is tapered, the gap becomes continuously narrower from the second gap width to the first gap width along an entire length of the gap, wherein the plurality of locking plates, when in an assembled position, are arranged between a plurality of retaining annular grooves arranged in the rotor disc and the plurality of blades, and wherein a border of each locking plate includes two opposing concentric circular arcs and two opposing non-parallel straight lines.

2. The turbine rotor as claimed in claim 1, wherein a ratio of the at least one second gap width to the corresponding first gap width is in a range between 1.1:1 to 10:1.

3. The turbine rotor as claimed in claim 1, wherein at least a majority of the first gap widths is smaller than the corresponding second gap widths.

4. The turbine rotor as claimed in claim 1, wherein each locking plate extends circumferentially over at least two neighbouring halves of the blade roots, and wherein the plurality of locking plates are sized and configured to cover and seal the plurality of gaps between the plurality of blade roots and the rotor disc.

5. A method of arranging the plurality of locking plates on a rotor disc, comprising:

arranging a first locking plate on a periphery of the rotor disc; and arranging a second locking plate adjacent to the first locking plate, wherein a gap between the first and the second locking plate is formed, wherein a first gap width is formed on a radially outermost end of the neighbouring first and second locking plates, the first gap formed relative to an axis of rotation of the rotor disc, and a second gap width is formed on a radially innermost end of the neighbouring first and second locking plates, the second gap formed relative to the axis of rotation of the rotor disc, wherein the first gap width is smaller than the corresponding second gap width such that the gap formed by the corresponding first gap width and the second gap width is tapered, the gap becomes continuously narrower from the second gap width to the first gap width along an entire length of the gap, wherein the first locking plate and the second locking plate, when in an assembled position, are arranged between a plurality of retaining annular grooves arranged in the rotor disc and a plurality of blades, and wherein a border of each locking plate includes two opposing concentric circular arcs and two opposing non-parallel straight lines.

6. The method as claimed in claim 5, wherein a ratio of the wide end to a corresponding narrow end is in a range between 1.1:1 to 10:1.

7. The method as claimed in claim 5, wherein the first locking plate and second locking plate extend circumferentially over at least two neighbouring halves of a plurality of blade roots, and wherein the first locking plate and the second locking plate are sized and configured to cover and seal the gap between the plurality of blade roots and the rotor disc.

* * * * *

UNITED STATES PATENT AND TRADEMARK OFFICE

CERTIFICATE OF CORRECTION

PATENT NO. : 8,128,373 B2
APPLICATION NO. : 12/311255
DATED : March 6, 2012
INVENTOR(S) : Rene James Webb It is certified that error appears in the above-identified patent and that said Letters Patent is hereby corrected as shown below:

Col. 3, line 36, remove [foamed] and insert --formed--

Signed and Sealed this
Fourth Day of December, 2012

David J. Kappos

David J. Kappos
*Director of the United States Patent and Trademark Office*